US008113876B1

(12) United States Patent
Rossman et al.

(10) Patent No.: US 8,113,876 B1
(45) Date of Patent: Feb. 14, 2012

(54) ELECTRICAL CONNECTOR FOR PROVIDING ELECTRICAL POWER TO AN ANTENNA

(75) Inventors: Jared Evan Rossman, Dover, PA (US); John Eugene Westman, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/842,656

(22) Filed: Jul. 23, 2010

(51) Int. Cl.
*H01R 9/05* (2006.01)

(52) U.S. Cl. ..... 439/578; 439/584; 439/607.41

(58) Field of Classification Search ..... 439/578, 439/584, 98, 607.41, 607.42, 607.45, 607.48, 439/607.5, 607.52
See application file for complete search history.

(56) References Cited

U.S. PATENT DOCUMENTS

| | | | | |
|---|---|---|---|---|
| 3,622,952 | A * | 11/1971 | Hilbert | 439/607.41 |
| 4,433,206 | A * | 2/1984 | Lewis | 174/359 |
| 6,884,113 | B1 * | 4/2005 | Montena | 439/578 |
| 7,611,378 | B1 | 11/2009 | Brekosky et al. | |
| 7,942,699 | B1 * | 5/2011 | Rossman et al. | 439/607.41 |
| 7,972,172 | B2 * | 7/2011 | Huang et al. | 439/578 |
| 2008/0261445 | A1 * | 10/2008 | Malloy et al. | 439/578 |
| 2010/0151721 | A1 * | 6/2010 | Tyler | 439/465 |

* cited by examiner

*Primary Examiner* — Hae Moon Hyeon

(57) ABSTRACT

An electrical connector is provided for terminating an electrical cable having an insulated conductor surrounded by a ground shield. The electrical connector includes a housing, an electrical contact held by the housing, an inner ferrule configured to extend between the ground shield and the insulated conductor of the electrical cable, and an outer ferrule extending around the inner ferrule such that the ground shield of the electrical cable extends between the inner and outer ferrules when the electrical connector terminates the electrical cable. A rear cover is connected to the housing. The rear cover extends around and compresses the outer ferrule such that the ground shield of the electrical cable is captured between the inner and outer ferrules when the electrical connector terminates the electrical cable.

18 Claims, 8 Drawing Sheets

ELECTRICAL CONNECTOR FOR PROVIDING ELECTRICAL POWER TO AN ANTENNA

BACKGROUND OF THE INVENTION

The subject matter described and/or illustrated herein relates generally to electrical connectors, and more particularly, to electrical connectors for providing electrical power to antennas.

Antennas are used to transmit and receive radio waves for a variety of different purposes. For example, antennas are used in cellular communication networks for transmitting and receiving cellular phone communications. One example of an antenna used within cellular communication networks is a remote radio head. Antennas such as those used in the cellular communication networks require electrical power to transmit radio waves. Electrical power is delivered to the antenna via an electrical power cable that extends from a power source to the antenna.

Electrical power cables are often electrically connected to antennas using an electrical connector assembly. However, electrical connector assemblies used to interconnect electrical power cables to antennas are not without disadvantages. For example, at least some known electrical connector assemblies that interconnect electrical power cables and antennas are inadequately sealed from environmental conditions. Inadequate sealing of such connector assemblies may expose the internal structure of the connector assembly, such as electrical contacts thereof, to adverse environmental conditions, which may damage the connector assembly.

Moreover, electrical power cables sometimes include a ground shield that extends around the power conductors of the cable. The electrical connector assembly includes an electrical connector that terminates the electrical power cable. The electrical connector typically includes a housing holding electrical contacts, and inner and outer ferrules that capture an end of the ground shield therebetween. A cover that is threadably connected to the housing extends over the inner and outer ferrules. However, rotation of the cover during connection of the cover to the housing may also rotate the inner ferrule, the outer ferrule, and/or the ground shield. Rotation of the ground shield may damage the ground shield, which may cause the ground shield to be less effective. Rotation of the inner and/or outer ferrules may cause the ground shield to become disconnected from the ferrules, thereby possibly rendering the ground shield less effective and/or breaking a ground path through the electrical connector.

BRIEF DESCRIPTION OF THE INVENTION

In one embodiment, an electrical connector is provided for terminating an electrical cable having an insulated conductor surrounded by a ground shield. The electrical connector includes a housing, an electrical contact held by the housing, an inner ferrule configured to extend between the ground shield and the insulated conductor of the electrical cable, and an outer ferrule extending around the inner ferrule such that the ground shield of the electrical cable extends between the inner and outer ferrules when the electrical connector terminates the electrical cable. A rear cover is connected to the housing. The rear cover extends around and compresses the outer ferrule such that the ground shield of the electrical cable is captured between the inner and outer ferrules when the electrical connector terminates the electrical cable.

In another embodiment, an electrical connector assembly includes a mating connector and an electrical connector for terminating an electrical cable having an insulated conductor surrounded by a ground shield. The electrical connector includes a housing configured to mate with the mating connector, an electrical contact held by the housing, an inner ferrule configured to extend between the ground shield and the insulated conductor of the electrical cable, and an outer ferrule extending around the inner ferrule such that the ground shield of the electrical cable extends between the inner and outer ferrules when the electrical connector terminates the electrical cable. A rear cover is connected to the housing. The rear cover extends around and compresses the outer ferrule such that the ground shield of the electrical cable is captured between the inner and outer ferrules when the electrical connector terminates the electrical cable.

In another embodiment, an electrical connector is provided for terminating an electrical cable having an insulated conductor surrounded by a ground shield. The electrical connector includes a housing comprising a keying member, an electrical contact held by the housing, an inner ferrule configured to extend between the ground shield and the insulated conductor of the electrical cable, the inner ferrule comprising a keying element, and an outer ferrule extending around the inner ferrule such that the ground shield of the electrical cable extends between the inner and outer ferrules when the electrical connector terminates the electrical cable. A rear cover is connected to the housing. The rear cover extends around the outer ferrule. The keying member of the housing and the keying element of the inner ferrule cooperate to prevent relative rotation of at least one of the inner ferrule, the outer ferrule, or the ground shield of the electrical cable during connection of the rear cover to the housing.

DETAILED DESCRIPTION OF THE INVENTION

Figure 1:
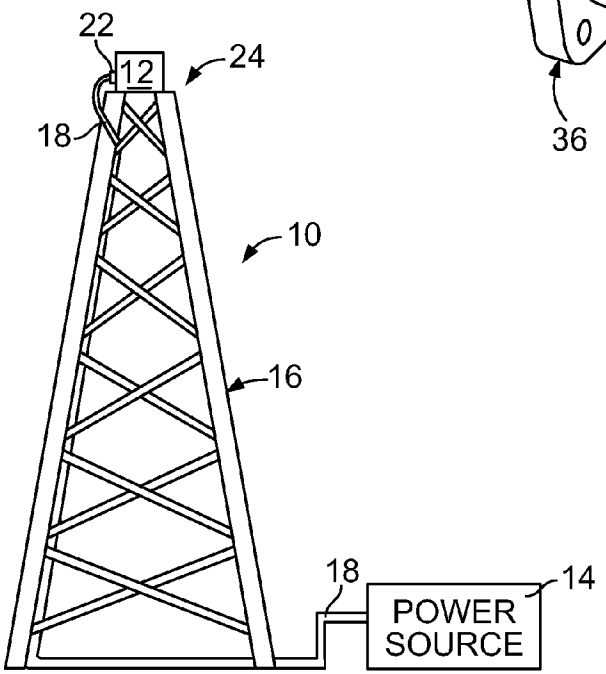
FIG. 1 is schematic diagram of an exemplary embodiment of a radio wave transmission and reception system.

FIG. 1 is schematic diagram of an exemplary embodiment of radio wave transmission and reception system 10. The system 10 includes an antenna 12, a source 14 of electrical power, and an optional tower 16. The antenna 12 transmits and receives radio waves. The electrical power source 14 is electrically connected to the antenna 12 for powering operation of the antenna 12. The electrical power source 14 is electrically connected to the antenna 12 via an electrical power cable 18 that includes one or more electrical conductors 20 (FIGS. 2 and 9) for transmitting electrical power to the antenna 12. As well be described in more detail below, the electrical power cable 18 is electrically connected to the antenna 12 using an electrical connector assembly 22.

In the exemplary embodiment, the antenna 12 is a remote radio head used for cell phone communication. But, the subject matter described and/or illustrated herein is not limited to remote radio heads. Rather, the subject matter described and/or illustrated herein may be used with any type of antenna. Accordingly, the antenna 12 may alternatively be any other type of antenna for transmitting and receiving radio waves for any purpose. Moreover, although shown as being mounted on a top 24 of the tower 16, the antenna 12 may alternatively be mounted at any other location on the tower 16 or at any location on another structure. For example, other structures on which the antenna 12 may be mounted include, but are not limited to, within a building, on the roof of a building, on a pole, on a wall, at ground level, and/or the like.

Figure 2:
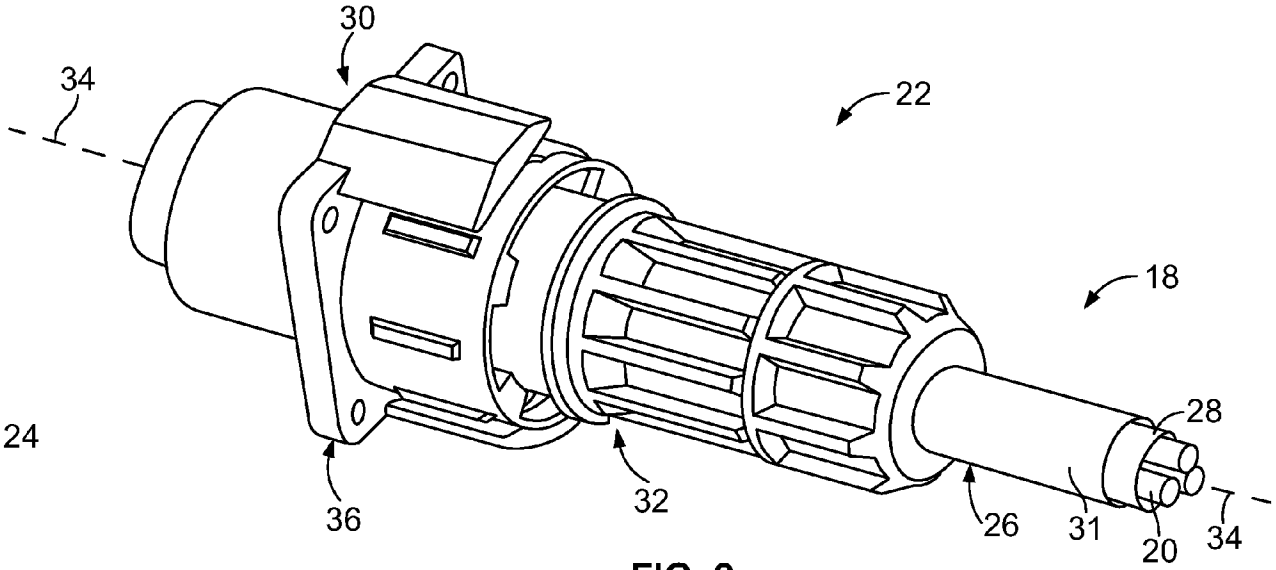
FIG. 2 is a perspective view of an exemplary embodiment of an electrical connector assembly for use within the system shown in FIG. 1.

FIG. 2 is a perspective view of an exemplary embodiment of the electrical connector assembly 22. An end 26 of the electrical power cable 18 is also shown in FIG. 2. A portion of the electrical power cable 18 has been broken away in FIG. 2 to illustrate the structure of the cable 18. In the exemplary embodiment, the electrical power cable 18 includes three insulated electrical conductors 20 surrounded by an electrically conductive ground shield 28, which is surrounded by a cable jacket 31. The electrical power cable 18 may include any other number of the insulated electrical conductors 20.

The electrical connector assembly 22 includes two electrical connectors 30 and 32 that mate together along a mating axis 34. The electrical connector 32 terminates the end 26 of the electrical power cable 18 such that the electrical connector 32 is electrically connected to the electrical conductors 20 of the cable 18. The electrical connector 30 is configured to be electrically connected to the antenna 12 (FIG. 1). When the connectors 30 and 32 are mated together, the electrical connector assembly 22 provides an electrical pathway from the electrical power cable 18 to the antenna 12. The electrical connector 30 includes a mounting flange 36 that is electrically conductive. As will be described in more detail below, when the connectors 30 and 32 are mated together, the mounting flange 36 is electrically connected to the ground shield 28 of the cable 18 to provide an electrical ground path through the assembly 22. Each of the electrical connectors 30 and 32 may be referred to herein as a "mating connector".

Figure 3:
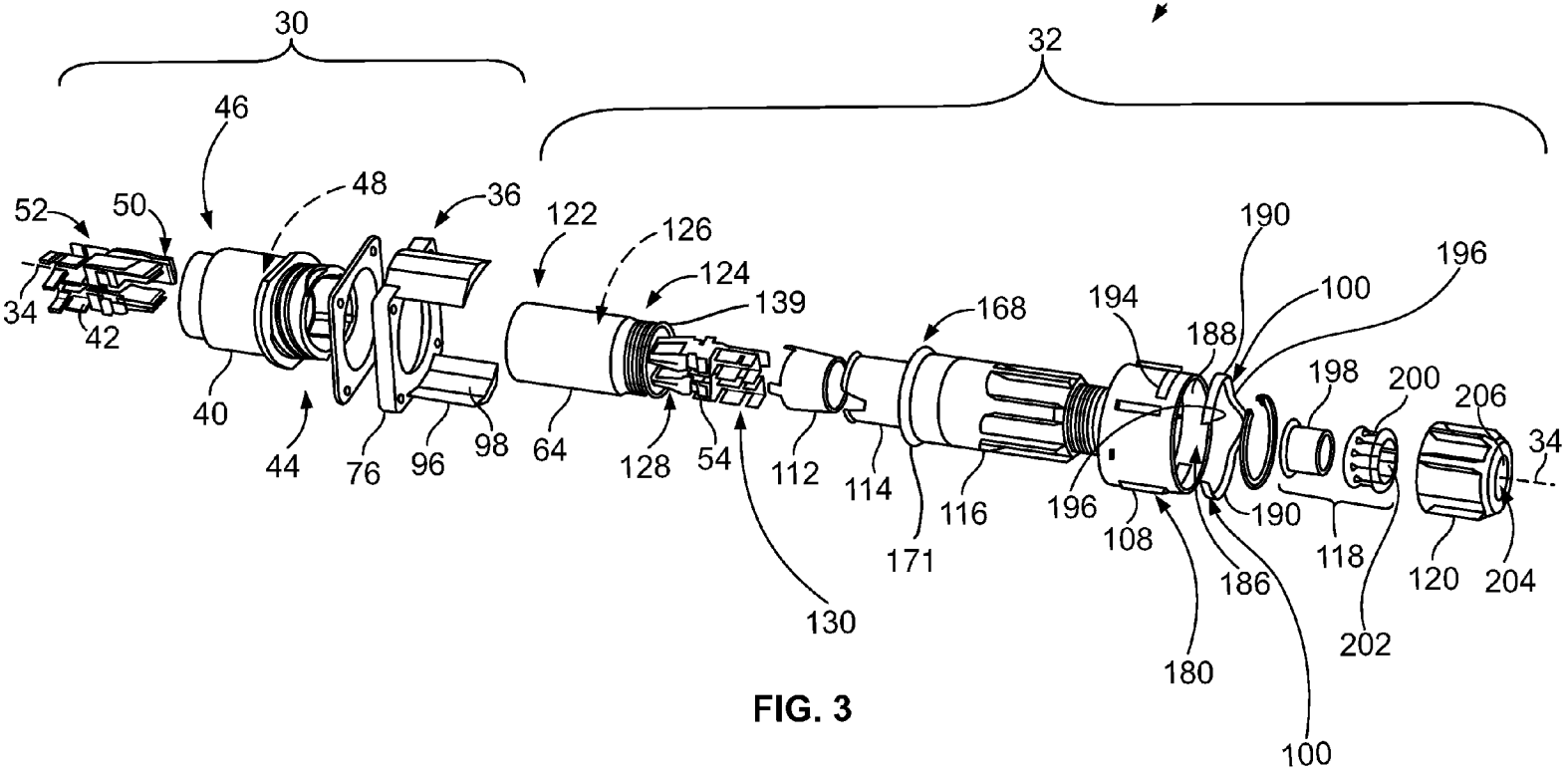
FIG. 3 is an exploded perspective view of the electrical connector assembly shown in FIG. 2.
Figure 4:
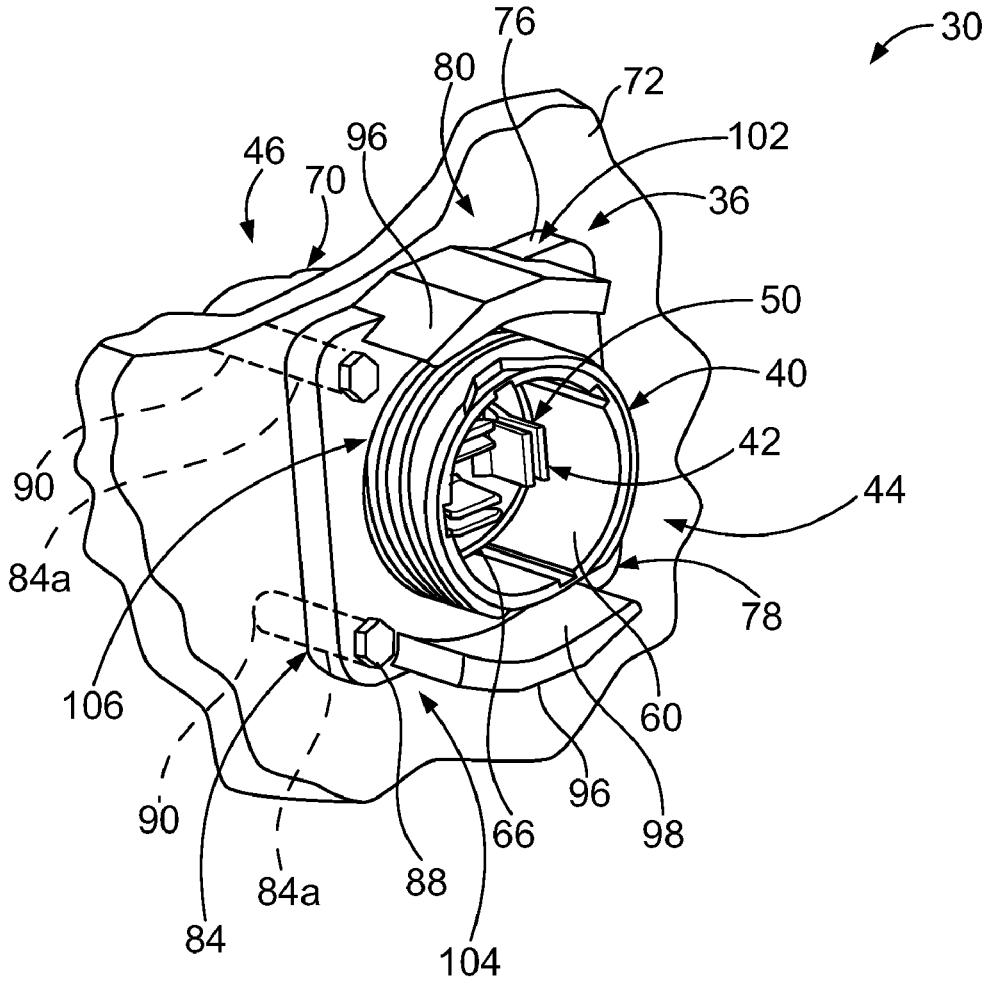
FIG. 4 is a perspective view of an exemplary embodiment of an electrical connector of the electrical connector assembly shown in FIGS. 2 and 3.
Figure 5:
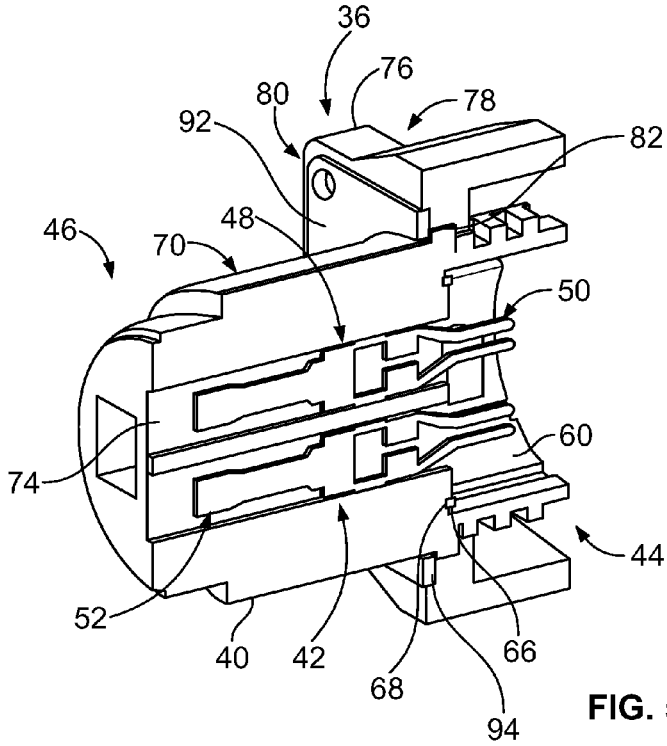
FIG. 5 is a perspective view illustrating a cross section of the electrical connector shown in FIG. 4.

FIG. 3 is an exploded perspective view of the electrical connector assembly 22. FIG. 4 is a perspective view of an exemplary embodiment of the electrical connector 30. FIG. 5 is a perspective view illustrating a cross section of the electrical connector 30. The electrical connector 30 is shown in FIG. 4 being mounted to a housing panel 72 of the antenna 12 (FIG. 1). Referring now to FIGS. 3-5, the electrical connector 30 includes a housing 40, one or more electrical contacts 42, and the mounting flange 36. The housing 40 extends a length from a mating end 44 to a mounting end 46. The housing 40 includes an interior cavity 48 within which the electrical contacts 42 are held. The mating end 44 of the housing 40 is threaded for connection to a twist ring 108 (FIGS. 3, 6, 9, and 10) of the electrical connector 32 (FIGS. 2, 3, 6, 9, and 10). In the exemplary embodiment, the housing 40 is electrically non-conductive. More particularly, the exemplary embodiment of the housing 40 is formed entirely from dielectric materials. Alternatively, a portion of the housing 40 is electrically conductive. For example, in some alternative embodiments, an exterior of the housing 40 includes an electrically conductive layer (not shown).

Referring now to FIGS. 3 and 5, each of the electrical contacts 42 includes a mating segment 50 and a mounting segment 52. The mating segment 50 of each electrical contact 42 is configured to mate with a corresponding electrical contact 54 (not shown in FIG. 5) of the electrical connector 32 (not shown in FIG. 5). The mounting segment 52 of each electrical contact 42 is configured to be electrically connected to the antenna 12. More particularly, the mounting segments 52 of the electrical contacts 42 are configured to engage corresponding electrical contacts (not shown) of the antenna 12. For example, the antenna 12 may include a complementary connector (not shown) that holds the electrical contacts of the antenna 12 and mates with the electrical connector 30 to electrically connect the electrical connector 30 to the antenna 12. Although three are shown, the electrical connector 30 may include any number of the electrical contacts 42 for mating with any number of electrical contacts 54 of the electrical connector 32 and any number of electrical contacts of the antenna 12. In the exemplary embodiment, the mating segments 50 of the electrical contacts 42 include opposing fingers that define a receptacle therebetween for receiving a finger of the corresponding electrical contact 54 therein. But, the mating segments 50 of the electrical contacts 42 may additionally or alternatively include any other structure for mating with an electrical contact 54 having any structure. Similarly, the mounting segment 52 of each electrical contact 42 may include any other structure, in addition or alternative to that shown herein, for mating with an electrical contact of the antenna 12 having any structure.

Referring now to FIGS. 4 and 5, the mating end 44 of the housing 40 includes a receptacle 60 that is configured to receive a plug 62 (FIG. 6) of a housing 64 (FIGS. 3, 6, 7, and 9) of the electrical connector 32 (FIGS. 2, 3, 6, 9, and 10) therein. The mating segments 50 of the electrical contacts 42 extend within the receptacle 60 for mating with the electrical contacts 54 (FIGS. 6 and 9) of the electrical connector 32. Optionally, a gasket 66 is held within the receptacle 60 for sealing engagement between the housings 40 and 64. Referring now to FIG. 5, the housing 40 includes an optional groove 68 for holding the gasket 66. In an alternative embodiment, the mating end 44 of the housing 40 includes a plug (not shown) that is configured to be received within a receptacle (not shown) of the housing 64 of the electrical connector 32.

The exemplary embodiment of the mounting end 46 of the housing 40 includes a plug 70 that is configured to be received within a receptacle (not shown) of the antenna 12 (FIG. 1). For example, the receptacle of the antenna 12 may be a receptacle formed within a housing (not shown) of the complementary connector of the antenna 12. The mounting segments 52 of the electrical contacts 42 extend within the plug 70 for mating with the electrical contacts of the antenna 12. More particularly, the mounting segments 52 of the electrical contacts 42 extend within one or more corresponding ports 74 that extend into the plug 70. The electrical contacts of the antenna 12 are received within corresponding ones of the ports 74 for mating with the mounting segments 52 of the electrical contacts 42 therein. The mounting end 46 of the housing 40 alternatively includes a receptacle (not shown) that is configured to receive a plug of the antenna 12 therein. For example, the plug of the antenna 12 may be a plug of the housing of the complementary connector of the antenna 12.

The mounting flange 36 includes a base 76 having a mating side 78 and an opposite mounting side 80. An opening 82 extends through the base 76. The housing 40 of the electrical connector 30 is held within the opening 82 of the base 76. When the housing 40 is held in the opening 82, the base 76 of the mounting flange 36 extends outwardly from a periphery of the housing 40. The housing 40 may be held within the opening 82 of the mounting flange 36 using any suitable type of connection. In the exemplary embodiment, the housing 40 is held within the opening 82 using an interference fit connection. Other examples of connections for holding the housing 40 within the opening 82 include, but are not limited to, an adhesive, a snap-fit connection, a latch, a threaded fastener, another type of fastener, and/or the like.

Referring now to FIG. 4, the electrical connector 30 is configured to be mounted to the housing panel 72 of the antenna 12. More particularly, the mounting flange 36 of the electrical connector 30 is configured to be mounted to the housing panel 72. The mounting flange 36 includes one or more mounting components 84 for securing the mounting flange 36 to the housing panel 72. In the exemplary embodiment, the mounting components 84 include mounting openings 84*a* that extend through the base 76. Each mounting opening 84*a* receives a threaded fastener 88 that extends through a corresponding opening 90 within the housing panel 72. In the exemplary embodiment, the openings 90 within the housing panel 72 are threaded and the threaded fasteners 88 are threadably connected to the threads of the openings 90 to secure the mounting flange 36 to the housing panel 72. Alternatively, the threaded fasteners 88 threadably connect to threads of the mounting openings 84*a* of the mounting flange 36 to secure the mounting flange 36 to the housing panel 72. In still other alternative embodiments, the threaded fasteners 88 are threadably connected to corresponding nuts (not shown) that engage the housing panel 72 or the mating side 78 of the mounting flange 36. In addition or alternative to the mounting components 84, the threaded fasteners 88, the threads, and/or the nuts, the mounting flange 36 may be secured to the housing panel 72 using any other suitable connection, fastener, and/or the like. Examples of other connections for securing the mounting flange 36 to the housing panel 72 include, but are not limited to, an adhesive, a snap-fit connection, a press-fit connection, a latch, another type of fastener, and/or the like.

When the mounting flange 36 of the electrical connector 30 is secured to the housing panel 72 of the antenna 12, the mounting side 80 of the base 76 of the mounting flange 36 is engaged with the housing panel 72. The engagement between the mounting flange 36 and the housing panel 72 creates an electrical connection between the mounting flange 36 and the housing panel 72. As will be described in more detail below, the mounting flange 36 thereby provides an electrical ground path between the electrical connector 32 (FIGS. 2, 3, 6, 9, and 10) and the housing panel 72. In addition or alternative to the engagement between the mounting flange 36 and housing panel 72, the threaded fasteners 88, the nuts, and/or the other exemplary connections may create the electrical connection between the mounting flange 36 and housing panel 72. For example, is some alternative embodiments, the mounting side 80 of the base 76 of the mounting flange 36 is not engaged with the housing panel 72 when the mounting flange 36 is secured to the housing panel 72, but the threaded fasteners 88 provide the electrical connection between the mounting flange 36 and the housing panel 72.

Referring now to FIG. 5, optionally, the electrical connector 30 includes a gasket 92 engaged between the mounting flange 36 and the housing panel 72 of the antenna 12. In the exemplary embodiment, the mounting side 80 of the mounting flange 36 includes a recess 94 for receiving the gasket 92 therein. Optionally, the gasket 92 and the recess 94 are relatively sized such that the gasket 92 extends flush with the mounting side 80 of the mounting flange 36 when the gasket 92 is received within the recess 94. Accordingly, in the exemplary embodiment, the mounting side 80 of the mounting flange 36 engages the housing panel 72 even when the gasket 92 is held therebetween.

Referring again to FIG. 4, and as briefly described above, the mounting flange 36 of the electrical connector 30 is electrically conductive and is configured to be electrically connected to the ground shield 28 (FIGS. 2 and 9) of the electrical power cable 18 (FIGS. 1, 2, 6, and 9). In the exemplary embodiment, the electrical connection between the mounting flange 36 and the ground shield 28 is partially provided by one or more ground tabs 96 of the mounting flange 36. The ground tabs 96 extend outwardly from the mating side 78 of the base 76 of the mounting flange 36. Each ground tab 96 includes a radially inner surface 98. As will be as described in more detail below, the radially inner surfaces 98 of the ground tabs 96 engage corresponding ground fingers 100 (FIGS. 3 and 9) of the electrical connector 32. The ground fingers 100 of the electrical connector 32 are electrically connected to the ground shield 28 of the electrical cable 18 such that the engagement between the ground tabs 96 and the ground fingers 100 electrically connects the ground tabs 96 to the ground shield 28.

In the exemplary embodiment, the mounting flange 36 includes two ground tabs 96 that extend from opposite ends 102 and 104 of the mounting flange 36. The ground tabs 96 are spaced apart along the base 76 to define a gap 106 therebetween. The mounting flange 36 is configured to receive a twist ring 108 (FIGS. 3, 6, 9, and 10) of the electrical connector 32 within the gap 106 between the ground tabs 96 when the electrical connectors 30 and 32 are mated together. Optionally, the radially inner surfaces 98 of the ground tabs 96 have a shape that is complementary with an exterior surface of the twist ring 108. Although two are shown, the mounting flange 36 may include any number of the ground tabs 96 for engagement with any number of ground fingers 100 of the electrical connector 32. Each ground tab 96 may have any location on the mounting flange 36, including any location relative to other ground tabs 96.

Figure 6:
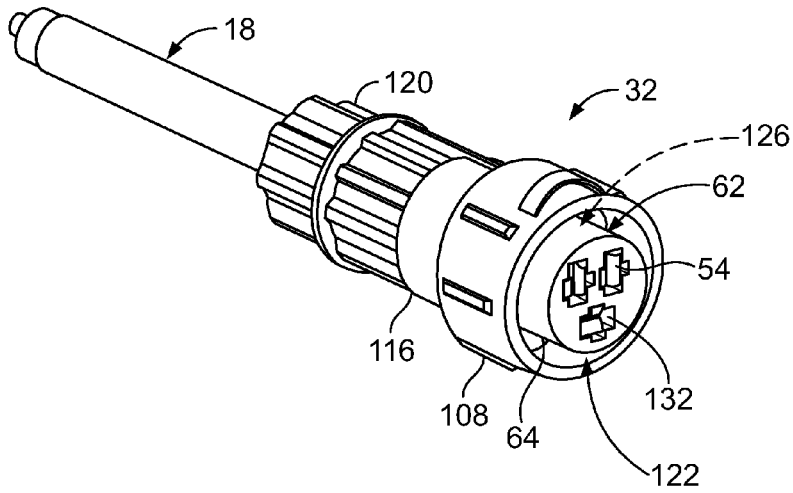
FIG. 6 as a perspective view of an exemplary embodiment of another electrical connector of the electrical connector assembly shown in FIGS. 2 and 3.

FIG. 6 as a perspective view of an exemplary embodiment of the electrical connector 32 illustrating the electrical connector 32 terminating the electrical power cable 18. Referring now to FIGS. 3 and 6, the electrical connector 32 includes the housing 64, one or more of the electrical contacts 54, an inner ferrule 112 (not visible in FIG. 6), an outer ferrule 114 (not visible in FIG. 6), a rear cover 116, the twist ring 108, an optional wire gland 118 (not visible in FIG. 6), and an optional screw cap 120. The housing 64 extends a length from a mating end 122 to a mounting end 124 (not visible in FIG. 6). The housing 64 includes interior cavities 126 within which the electrical contacts 54 are held. In the exemplary embodiment, the housing 64 is electrically non-conductive. More particularly, the exemplary embodiment of the housing 64 is formed entirely from dielectric materials. Alternatively, a portion of the housing 64 is electrically conductive. For example, in some alternative embodiments, an exterior of the housing 64 includes an electrically conductive layer (not shown).

Referring now to FIG. 3, each of the electrical contacts 54 includes a mating segment 128 and a mounting segment 130. The mating segment 128 of each electrical contact 54 is configured to mate with the mating segment 50 of the corresponding electrical contact 42 of the electrical connector 30. The mounting segment 130 of each electrical contact 54 is configured to be electrically connected to a corresponding one of the insulated conductors 20 (FIGS. 2 and 9) of the electrical power cable 18 (FIGS. 1, 2, 6, and 9). Although three are shown, the electrical connector 32 may include any number of the electrical contacts 54 for mating with any number of electrical contacts 42 of the electrical connector 30 and any number of insulated conductors 20 of the electrical power cable 18. In the exemplary embodiment, the mating segments 128 of the electrical contacts 54 include opposing fingers that define a receptacle therebetween for receiving a finger of the corresponding electrical contact 42 therein. But, the mating segments 128 of the electrical contacts 54 may additionally or alternatively include any other structure for mating with an electrical contact 42 having any structure. Similarly, the mounting segment 130 of each electrical contact 54 may include any other structure, in addition or alternative to that shown herein, for being electrically connected to the insulated conductors 20 of the electrical power cable 18.

Referring again to FIG. 6, in the exemplary embodiment, the mating end 122 of the housing 64 includes the plug 62 that is configured to be received within the receptacle 60 (FIGS. 4 and 5) of the housing 40 (FIGS. 3-5 and 9) of the electrical connector 30 (FIGS. 2-5 and 9). The mating segments 128 of the electrical contacts 54 extend within the plug 62 for mating with the electrical contacts 42 (FIGS. 3-5 and 9) of the electrical connector 30. More particularly, the mating segments 128 of the electrical contacts 54 extend within one or more corresponding ports 132 that extend into the plug 62. The electrical contacts 42 of the electrical connector 30 are received within corresponding ones of the ports 132 for mating with the mating segments 128 of the electrical contacts 54 therein. In an alternative embodiment, the mating end 122 of the housing 64 includes a receptacle (not shown) that is configured to receive a plug (not shown) of the housing 40 of the electrical connector 30.

Figure 7:
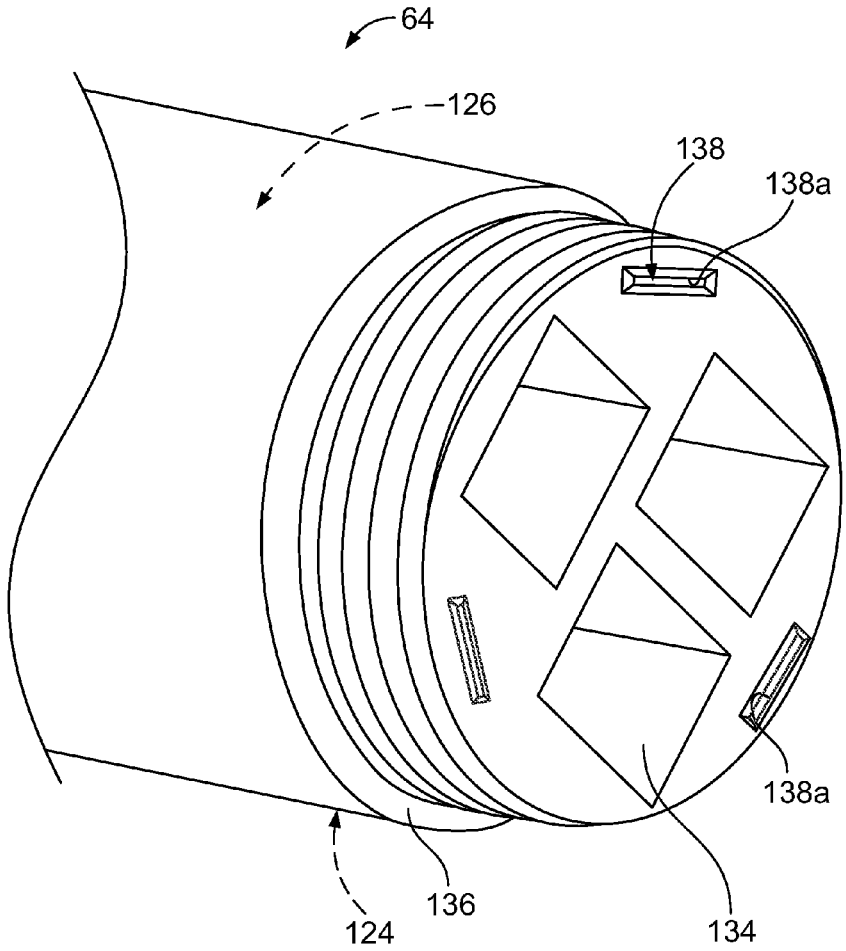
FIG. 7 is a perspective view of a portion of an exemplary embodiment of a housing of the electrical connector shown in FIG. 6.

FIG. 7 is a perspective view of a portion of the housing 64 of the electrical connector 32 illustrating the mounting end 124 of the housing 64. The mounting end 124 of the housing 64 includes one or more ports 134 that receive the insulated conductors 20 (FIGS. 2 and 9) of the electrical power cable 18 therein. Each interior cavity 126 communicates with a corresponding one of the ports 132 (FIG. 6) and a corresponding one of the ports 134. The mounting segments 130 of the electrical contacts 54 (FIGS. 2, 6, and 9) are arranged within corresponding interior cavities 126 of the housing 64 for engagement, and thus electrical connection, with the insulated conductor 20 received within the corresponding port 134. The mounting end 124 of the housing 64 is threaded for connection to the rear cover 116. Optionally, the mounting end 124 of the housing 64 includes a ledge 136 that engages an optional gasket 139 (FIG. 3) that extends around the mounting end 124 of the housing 64 for sealing engagement between the housing 64 and the rear cover 116.

In the exemplary embodiment, the mounting end 124 of the housing 64 includes one or more keying components 138 that cooperate with corresponding keying components 140 (FIG. 8) of the inner ferrule 112 (FIGS. 3, 8, and 9), as will be described below. In the exemplary embodiment, the keying components 138 include keying slots 138*a* that extend into the mounting end 124 of the housing 64 and receive keying tabs 140*a* of the inner ferrule 112 therein. Alternatively, the keying components 138 include keying tabs (not shown) that are received within keying slots (not shown) of the inner ferrule 112. Although three are shown, the housing 64 may include any number of the keying components 138 for cooperating with any number of keying components 140 of the inner ferrule 112. Each keying component 138 may have any location on the housing 64, including any location relative to other keying components 138. Each of the keying components 138 may be referred to herein as a "keying element" and/or a "keying member".

Figure 8:
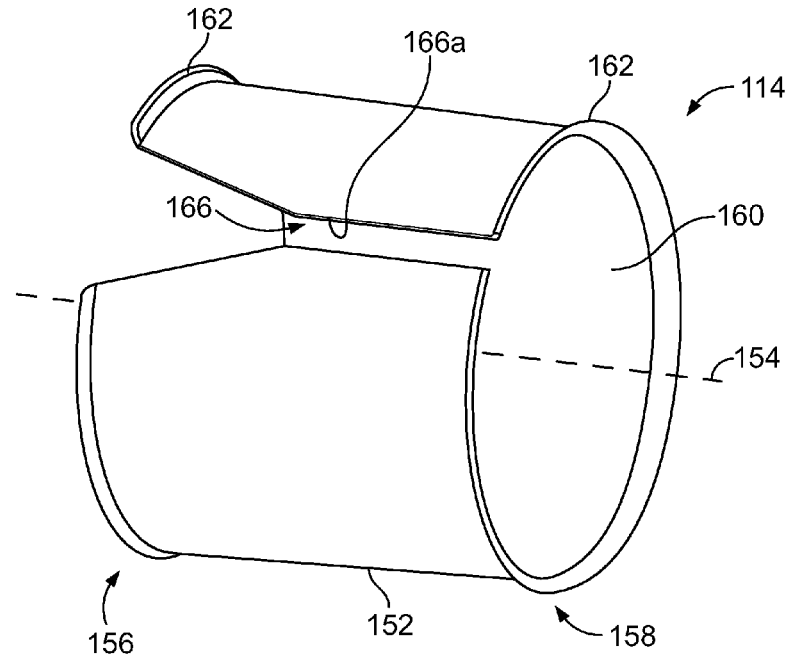
FIG. 8 is a perspective view illustrating an exemplary embodiment of an inner ferrule and an exemplary embodiment of an outer ferrule of the electrical connector shown in FIG. 6.
Figure 8:
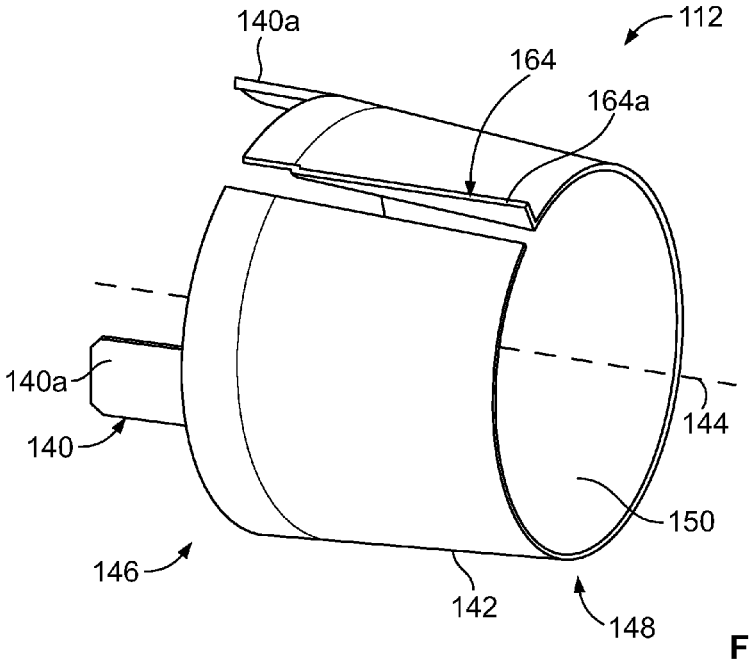

FIG. 8 is a perspective view illustrating the inner and outer ferrules 112 and 114, respectively, of the electrical connector 32 (FIGS. 2, 3, 6, 9, and 10). As will be described below, the inner and outer ferrules 112 and 114, respectively, are configured to capture an end 149 of the ground shield 28 (FIGS. 2 and 9) of the electrical power cable 18 therebetween. The inner ferrule 112 includes a cylindrical body 142 that extends a length along a central longitudinal axis 144 from an end 146 to an opposite end 148. The body 142 includes a central opening 150 that is configured to receive the insulated conductors 20 (FIGS. 2 and 9) of the electrical power cable 18 therethrough. When the electrical connector 30 terminates the electrical power cable 18, the inner ferrule 112 extends between the ground shield 28 and the insulated conductors 20 of the electrical power cable 18.

The inner ferrule 112 includes the keying components 140 that cooperate with the keying components 138 (FIG. 7) of the housing 64 (FIGS. 3, 6, 7, and 9). In the exemplary embodiment, the keying components 140 include the keying tabs 140*a*, which extend outwardly along the central longitudinal axis 144 at the end 146 of the body 142. Alternatively, the keying components 140 include keying slots (not shown) that receive keying tabs (not shown) of the housing 64. Although three are shown, the inner ferrule 112 may include any number of the keying components 140 for cooperating with any number of keying components 138 of the housing 64. Each keying component 140 may have any location on the body 142, including any location relative to other keying components 140. Each of the keying components 140 may be referred to herein as a "keying element" and/or a "keying member".

The outer ferrule 114 includes a cylindrical electrically conductive body 152 that extends a length along a central longitudinal axis 154 from an end 156 to an opposite end 158. The body 152 includes a central opening 160 that is configured to receive the inner ferrule 112 and the ground shield 28 therein. When the electrical connector 30 terminates the electrical power cable 18, the outer ferrule 114 extends around the inner ferrule 112 and the end 149 of the ground shield 28 such that the end 149 of the ground shield 28 extends between the inner and outer ferrules 112 and 114, respectively. In the exemplary embodiment, a flange 162 extends radially outwardly (relative to the central longitudinal axis 154) at each of the ends 156 and 158 of the body 152. Although two are shown, the body 152 may include any number of the flanges 162. Moreover, the flanges 162 are not limited to being located at the ends 156 and/or 158. Rather, each flange 162 may have any location along the length of the body 152.

The inner and outer ferrules 112 and 114 also include keying components 164 and 166, respectively, that cooperate with each other. In the exemplary embodiment, the keying component 164 of the inner ferrule 112 includes a keying tab 164*a* that extends radially outwardly (relative to the central longitudinal axis 144) from the body 142, and the keying component 166 of the outer ferrule 114 includes a keying slot 166*a* that receives the keying tab 164*a* of the inner ferrule 112. Alternatively, the keying component 164 includes a keying slot (not shown) that receives a keying tab (not shown) of the outer ferrule 114. Although only one is shown, the inner ferrule 112 may include any number of the keying components 164 and the outer ferrule 114 may include any number of the keying components 166. Each keying component 164 and 166 may have any location on the respective body 142 and 152. Each of the keying components 164 may be referred to herein as a "keying element" and/or a "keying member". Each of the keying components 166 may be referred to herein as a "keying element" and/or a "keying member".

Figure 9:
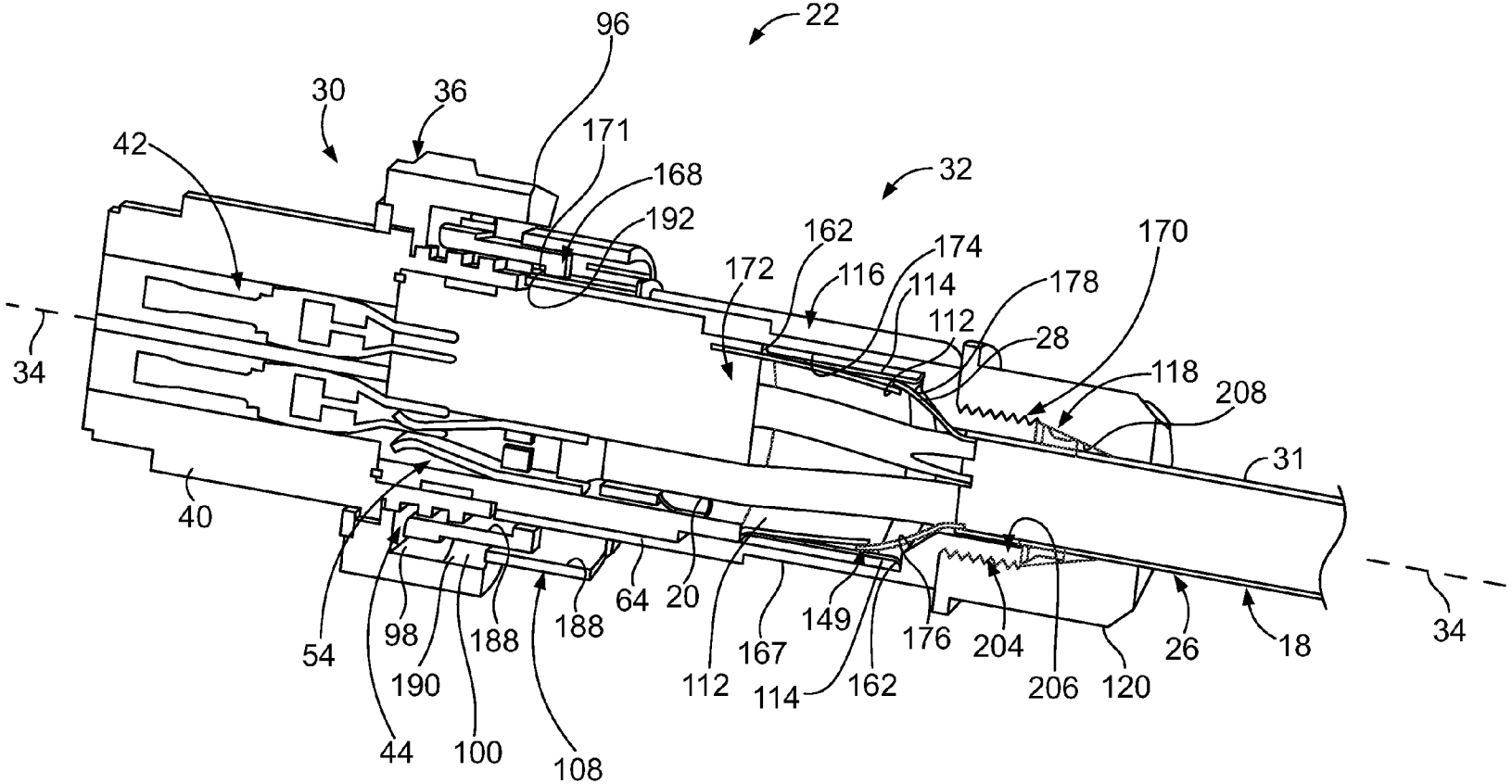
FIG. 9 is a perspective view illustrating a cross section of the electrical connector assembly shown in FIGS. 2 and 3.

FIG. 9 is a perspective view illustrating a cross section of the electrical connector assembly 22. The rear cover 116 of the electrical connector 32 includes an electrically conductive body 167 that extends a length from an end 168 to an opposite end 170. The end 170 is threaded for connecting the rear cover 116 to the screw cap 120. The rear cover 116 includes an optional flange 171 that extends radially outwardly (relative to the mating axis 34) at the end 168. The rear cover 116 includes an opening 172 that extends through the length thereof. The opening 172 is defined by an interior wall 174 of the rear cover 116 and receives the outer ferrule 114 therein. A portion of the interior wall 174 is threaded for threadably connecting the rear cover to the housing 64. Optionally, the interior wall 174 includes a tapered segment 176 that tapers radially inwardly (relative to the mating axis 34). When the electrical connector 30 terminates the electrical power cable 18, the tapered segment 176 engages the ground shield 28 to facilitate guiding the end 149 of the ground shield 28 between the inner and outer ferrules 112 and 114, respectively.

As will be described below, when the electrical connector 32 terminates the electrical power cable 18, the rear cover 116 extends around and compresses the outer ferrule 114 such that the end 149 of the ground shield 28 is compressed between the inner and outer ferrules 112 and 114, respectively. The compression of the outer ferrule 114 is applied thereto by engagement of the interior wall 174 with the flanges 162 of the outer ferrule 114. Optionally, the interior wall 174 includes a ledge 178 that engages one of the flanges 162 of the outer ferrule 114 to, for example, facilitate holding the outer ferrule 114 in position relative to the rear cover 116, the ground shield 28, and/or the inner ferrule 112.

Referring again to FIG. 3, the electrical connector 32 includes the twist ring 108, which connects to the housing 40 of the electrical connector 30 to facilitate holding the connectors 30 and 32 together in the mated state. The twist ring 108 includes a cylindrical body 180. The body 180 includes a central opening 186 that is configured to receive the rear cover 116 and the mating end 44 of the housing 40 of the electrical connector 30 therein. The central opening 186 is defined by an interior wall 188 of the twist ring 108.

The twist ring 108 includes the ground fingers 100 that engage the mounting flange 36 of the electrical connector 30. The ground fingers 100 are held by the body 180 of the twist ring 108 such that the ground fingers 100 extend radially outwardly (relative to the mating axis 34) from the body 180. Each ground finger 100 extends radially outwardly from the body 180 to a tip 190 that engages the radially inner surface 98 of the corresponding ground tab 96 of the mounting flange 36 when the connectors 30 and 32 are mated together. The ground fingers 100 are resilient springs such that the tips 190 are resiliently deflected radially inward (relative to the mating axis 34) when engaged with the ground tabs 96 of the mounting flange 36. The ground fingers 100 are electrically conductive such that the ground fingers are electrically connected to the mounting flange 36 when engaged with the ground tabs 96 thereof.

The ground fingers 100 extend through slots 194 within the body 180 of the twist ring 108 and into the central opening 186 of the twist ring 108. Each ground finger 100 extends from the tip 190 to a base 196 that extends within the central opening 186. The bases 196 of the ground fingers 100 are configured to engage the rear cover 116 at the end 168 of the rear cover 116 to electrically connect the ground fingers 100 to the rear cover 116.

In the exemplary embodiment, the ground fingers 100 are defined by a single spring member, such that the ground fingers 100 are connected to each other. Alternatively, the ground fingers 100 are discrete components from each other that are not mechanically interconnected. Whether or not the ground fingers 100 are defined by the single spring member or are discrete components, the ground fingers 100 may or may not be integrally formed with each other. Although three are shown, the twist ring 108 may include any number of the ground fingers 100.

Referring again to FIG. 9, the interior wall 188 of the twist ring 108 includes a threaded portion for threadably connecting the twist ring 108 to the mating end 44 of the housing 40 of the electrical connector 30. Optionally, the interior wall 188 of the twist ring 108 includes a ledge 192. The ledge 192 engages the flange 171 of the rear cover 116, for example, to facilitate holding the twist ring 108 over the rear cover 116 and/or to facilitate pulling the housings 40 and 64 together as the twist ring 108 is connected to the housing 40.

Referring again to FIG. 3, the wire gland 118 includes a base 198 and a sealing member 200 held by the base 198. The base 198 and sealing member 200 include central openings that extend therethrough. The sealing member 200 of the wire gland 118 includes a plurality of resilient spring fingers 202 that extend around the base 198. The screw cap 120 includes a central opening 204 that is defined by an interior wall 206 of the screw cap 120. As can be seen in FIG. 9, the interior wall 206 of the screw cap 120 includes a threaded portion for threadably connecting the screw cap 120 to the end 170 of the rear cover 116. The interior wall 206 also includes a tapered segment 208 that tapers radially inwardly (relative to the mating axis 34). When the electrical connector 32 terminates the electrical power cable 18, the electrical power cable 18 is configured to extend through the central openings within the base 198 and the sealing member 200 of the wire gland 118 such that the wire gland 118 extends around the cable jacket 31 of the cable 18. The wire gland 118 is received within the central opening 204 of the screw cap 120. As the screw cap 120 is connected to the rear cover 116, the tapered segment 208 of the screw cap 120 engages the spring fingers 202 of the wire gland 118 to deflect the spring fingers 202 radially inwardly and thereby compress the wire gland 118 between the cable jacket 31 and the interior wall 206 of the screw cap 120.

When the connector 32 terminates the end 26 of the electrical power cable 18 as shown FIG. 9, the electrical contacts 54 are engaged with and thereby electrically connected to corresponding ones of the insulated conductors 20 of the cable 18. The end 149 of the ground shield 28 of the electrical power cable 18 is captured between the inner and outer ferrules 112 and 114, respectively. More particularly, during connection of the rear cover 116 to the housing 64, the interior wall 174 of the rear cover 116 engages the flanges 162 of the outer ferrule 114 and compresses the outer ferrule 114 radially inwardly (relative to the mating axis 34). Compression of the outer ferrule 114 by the rear cover 116 compresses the end 149 of the ground shield 28 between the inner and outer ferrules 112 and 114, respectively. During connection of the rear cover 116 to the housing 64, the keying tabs 140*a* (FIG. 8) of the inner ferrule 112 are received within the keying slots 138*a* (FIG. 7) of the housing 64. Cooperation of the keying tabs 140*a* and the keying slots 138*a* may facilitate preventing relative rotation of the inner ferrule 112, the outer ferrule 114, and/or the ground shield 28 during connection of the rear cover 116 to the housing 64. Similarly, the keying tab 164*a* (FIG. 8) of the inner ferrule 112 is received within the keying slot 166*a* (FIG. 8) of the outer ferrule 114. Cooperation of the keying tab 164*a* and the keying slot 166*a* may facilitate preventing relative rotation of the inner ferrule 112, the outer ferrule 114, and/or the ground shield 28 during connection of the rear cover 116 to the housing 64.

Figure 10:
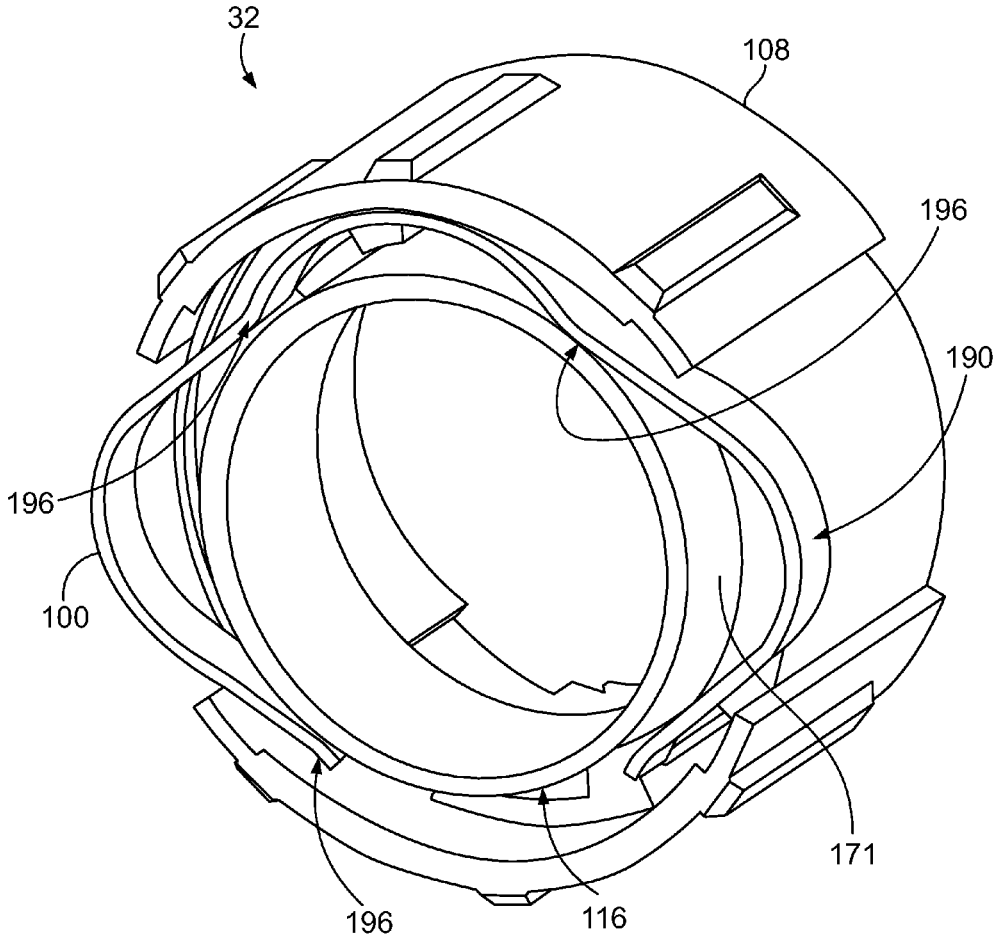
FIG. 10 is a perspective view of a portion of the electrical connector shown in FIG. 6.

When the connectors 30 and 32 are mated together as shown in FIG. 9, the electrical contacts 42 of the electrical connector 30 are mated with, and thereby electrically connected to, the electrical contacts 54 of the electrical connector 32. The electrical contacts 42 and 54 thereby provide an electrical path through the connector assembly 22 from the insulated conductors 20 of the electrical power cable 18 to the electrical contacts (not shown) of the antenna 12 (FIG. 1). The engagement between the outer ferrule 114 and the ground shield 28 electrically connects the ground shield 28 to the outer ferrule 114. The outer ferrule 114 is electrically connected to the rear cover 116 via the engagement of the flanges 162 of the outer ferrule 114 with the interior wall 174 of the rear cover 116. The bases 196 (FIG. 3) of the ground fingers 100 (FIGS. 3 and 9) of the twist ring 108 are engaged with the flange 171 of the rear cover 116 to electrically connect the rear cover 116 to the ground fingers 100. FIG. 10 is a perspective view of a portion of the electrical connector 32 illustrating a portion of the twist ring 108 and the rear cover 116. As can be seen in FIG. 10, the bases 196 of the ground fingers 100 of the twist ring 108 are engaged with the flange 171 of the rear cover 116 to electrically connect the rear cover 116 to the ground fingers 100.

Referring again to FIG. 9, the tips 190 of the ground fingers 100 are engaged with the radially inner surfaces 98 of the ground tabs 96 of the mounting flange 36. Accordingly, the spring fingers 100 are electrically connected to the mounting flange 36, which is electrically connected to the housing panel 72 (FIG. 4) of the antenna 12 as described above. As should be apparent from the description above, a ground path from the ground shield 28 of the electrical power cable 18 to the housing panel 72 of the antenna 12 is defined through the connector assembly 22. Specifically, the ground path is defined from the ground shield 28, through the outer ferrule 114, the rear cover 116, the ground fingers 110, and the mounting flange 36 to the housing panel 72.

In some embodiments, the electrical connector 30 is backwards compatible with electrical connectors (not shown) that are similar to the electrical connector 32 but do not carry an electrical ground connection from the ground shield 28. In other words, despite including the ground tabs 96 of the mounting flange 36, the electrical connector 30 is configured to mate with an electrical connector that is similar to the electrical connector 32 but does not include the ground fingers 100.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter described and/or illustrated herein without departing from its scope. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the above description and the drawings. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector for terminating an electrical cable having an insulated conductor surrounded by a ground shield, said electrical connector comprising:

a housing;

an electrical contact held by the housing;

an inner ferrule configured to extend between the ground shield and the insulated conductor of the electrical cable;

an outer ferrule extending around the inner ferrule such that the ground shield of the electrical cable extends between the inner and outer ferrules when the electrical connector terminates the electrical cable, the outer ferrule including a flange that extends radially outwardly; and a rear cover connected to the housing, the rear cover having an opening that receives the outer ferrule therein, the opening being defined by an interior wall of the rear cover, the rear cover extending around and compressing the outer ferrule such that the ground shield of the electrical cable is captured between the inner and outer ferrules when the electrical connector terminates the electrical cable, wherein the interior wall is engaged with the flange of the outer ferrule to apply the compression to the outer ferrule.

2. The electrical connector according to claim 1, wherein the interior wall has a ledge that engages the flange of the outer ferrule.

3. The electrical connector according to claim 1, wherein the inner ferrule comprises a keying member and the housing comprises a keying element, the keying member and the keying element cooperating to prevent relative rotation of at least one of the inner ferrule, the outer ferrule, or the ground shield of the electrical cable during connection of the rear cover to the housing.

4. The electrical connector according to claim 1, wherein the inner ferrule extends a length along a central longitudinal axis, the inner ferrule comprising a keying tab extending outwardly along the central longitudinal axis at an end of the inner ferrule, the housing comprising a keying slot, the keying tab of the inner ferrule being received within the keying slot.

5. The electrical connector according to claim 1, wherein the inner ferrule comprises a keying tab extending radially outwardly, the outer ferrule comprising a keying slot, the keying tab of the inner ferrule being received within the keying slot.

6. The electrical connector according to claim 1, further comprising a wire gland and a cap, the wire gland being configured to extend around the electrical cable, the cap having an opening that receives the wire gland therein, the opening being defined by an interior wall of the cap that includes a tapered segment that tapers radially inwardly, the tapered segment being engaged with the wire gland to compress the wire gland between the cap and the electrical cable.

7. The electrical connector according to claim 1, wherein the outer ferrule includes an end and the flange extends radially outwardly at the end.

8. The electrical connector according to claim 1, wherein the interior wall of the rear cover includes a tapered segment that tapers radially inwardly, the tapered segment being configured to engage the ground shield of the electrical cable when the electrical connector terminates the electrical cable.

9. The electrical connector according to claim 1, wherein the rear cover is threadably connected to the housing.

10. An electrical connector for terminating an electrical cable having an insulated conductor surrounded by a ground shield, said electrical connector comprising:

a housing;

an electrical contact held by the housing;

an inner ferrule configured to extend between the ground shield and the insulated conductor of the electrical cable, wherein the inner ferrule comprises a keying member;

an outer ferrule extending around the inner ferrule such that the ground shield of the electrical cable extends between the inner and outer ferrules when the electrical connector terminates the electrical cable, the outer ferrule comprising a keying element, the keying member and the keying element cooperating to prevent relative rotation of at least one of the inner ferrule, the outer ferrule, or the ground shield of the electrical cable during connection of the rear cover to the housing; and a rear cover connected to the housing, the rear cover extending around and compressing the outer ferrule such that the ground shield of the electrical cable is captured between the inner and outer ferrules when the electrical connector terminates the electrical cable.

11. An electrical connector assembly comprising:

a mating connector; and an electrical connector for terminating an electrical cable having an insulated conductor surrounded by a ground shield, said electrical connector comprising:

a housing configured to mate with the mating connector;

an electrical contact held by the housing;

an inner ferrule configured to extend between the ground shield and the insulated conductor of the electrical cable;

an outer ferrule extending around the inner ferrule such that the ground shield of the electrical cable extends between the inner and outer ferrules when the electrical connector terminates the electrical cable;

a rear cover connected to the housing, the rear cover extending around and compressing the outer ferrule such that the ground shield of the electrical cable is captured between the inner and outer ferrules when the electrical connector terminates the electrical cable;

a wire gland configured to extend around the electrical cable; and a cap having an opening that receives the wire gland therein, the opening being defined by an interior wall of the cap that includes a tapered segment that tapers radially inwardly, the tapered segment being engaged with the wire gland to compress the wire gland between the cap and the electrical cable.

12. The assembly according to claim 11, wherein the outer ferrule includes a flange that extends radially outwardly, the rear cover having a cover opening that receives the outer ferrule therein, the cover opening being defined by an interior wall of the rear cover, wherein the interior wall is engaged with the flange of the outer ferrule to apply the compression to the outer ferrule.

13. The assembly connector according to claim 11, wherein the inner ferrule comprises a keying member and the housing comprises a keying element, the keying member and the keying element cooperating to prevent relative rotation of at least one of the inner ferrule, the outer ferrule, or the ground shield of the electrical cable during connection of the rear cover to the housing.

14. The assembly according to claim 11, wherein the inner ferrule comprises a keying member and the outer ferrule comprises a keying element, the keying member and the keying element cooperating to prevent relative rotation of at least one of the inner ferrule, the outer ferrule, or the ground shield of the electrical cable during connection of the rear cover to the housing.

15. An electrical connector for terminating an electrical cable having an insulated conductor surrounded by a ground shield, said electrical connector comprising:

a housing comprising a keying member;

an electrical contact held by the housing;

an inner ferrule configured to extend between the ground shield and the insulated conductor of the electrical cable, the inner ferrule comprising a keying element;

an outer ferrule extending around the inner ferrule such that the ground shield of the electrical cable extends between the inner and outer ferrules when the electrical connector terminates the electrical cable; and a rear cover connected to the housing, the rear cover extending around the outer ferrule, wherein the keying member of the housing and the keying element of the inner ferrule cooperate to prevent relative rotation of at least one of the inner ferrule, the outer ferrule, or the ground shield of the electrical cable during connection of the rear cover to the housing.

16. The electrical connector according to claim 15, wherein the inner ferrule extends a length along a central longitudinal axis, the keying element of the inner ferrule comprising a keying tab extending outwardly along the central longitudinal axis at an end of the inner ferrule, the keying member of the housing comprising a keying slot, the keying tab of the inner ferrule being received within the keying slot of the housing.

17. The electrical connector according to claim 15, wherein the keying element of the inner ferrule is a first keying element and the keying member of the housing is a first keying member, the inner ferrule further comprising a second keying element, the outer ferrule comprising a second keying member, the second keying member of the outer ferrule and the second keying element of the inner ferrule cooperating to prevent relative rotation of at least one of the inner ferrule, the outer ferrule, or the ground shield of the electrical cable during connection of the rear cover to the housing.

18. The electrical connector according to claim 17, wherein the second keying element of the inner ferrule comprises a keying tab extending radially outwardly, the second keying member of the outer ferrule comprising a keying slot, the keying tab of the inner ferrule being received within the keying slot of the outer ferrule.

* * * * *